US006711371B2

(12) United States Patent
Koyama et al.

(10) Patent No.: US 6,711,371 B2
(45) Date of Patent: Mar. 23, 2004

(54) DEVELOPING DEVICE HAVING MEANS TO REMOVE DEVELOPER FROM A DEVELOPER SUPPLYING MEMBER

(75) Inventors: Tetsu Koyama, Tokyo (JP); Yoshitatsu Okiyama, Tokyo (JP); Teruaki Kuroda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/131,384

(22) Filed: Apr. 25, 2002

(65) Prior Publication Data

US 2002/0159796 A1 Oct. 31, 2002

(30) Foreign Application Priority Data

Apr. 26, 2001 (JP) ..... 2001-128963

(51) Int. Cl.[7] ..... G03G 15/08
(52) U.S. Cl. ..... 399/281
(58) Field of Search ..... 399/281, 283, 399/55, 285

(56) References Cited

U.S. PATENT DOCUMENTS 5,424,817 A * 6/1995 Iamamiya et al. ..... 399/281
6,072,975 A * 6/2000 Kyung ..... 399/281

* cited by examiner

*Primary Examiner*—William J. Royer
(74) *Attorney, Agent, or Firm*—Rabin & Berdo, PC

(57) ABSTRACT

To prevent irregular print density resulting from an uneven toner layer, a developer remover which may be a plurality of cylindrical members 31 formed like rollers, a net-like member, roller member and/or a contact member, are arranged in a manner to contact a sponge roller 22. When residual toner on the surface of a developing roller 21 is scraped off by the sponge roller 22, the developer remover pushes the toner away without allowing the toner to clot inside the sponge roller 22. Consequently, the sponge roller's performance to remove toner from itself to the developing roller 21 can be preserved for a long time.

10 Claims, 13 Drawing Sheets

DEVELOPING DEVICE HAVING MEANS TO REMOVE DEVELOPER FROM A DEVELOPER SUPPLYING MEMBER

FIELD OF THE INVENTION

The present invention relates to a developing device, and more particularly to a developing device in an electrophotographic recording apparatus.

RELATED ART

Generally, in an electrophotographic recording apparatus, a photosensitive body, the surface of which is uniformly charged, is irradiated with light to form an electrostatic latent image, and toner is deposited on the electrostatic latent image portion by an electrostatic force to produce a visible image, which is transferred to a printing medium, and fixed by heating the toner on the printing medium.

FIG. 11 is a block diagram of a developing device of reversal development type in a conventional electrophotographic recording apparatus. The device in FIG. 11 comprises a photosensitive drum 11, a charging roller 12, a print head 13, a developing device 14, and a transfer roller 15.

The photosensitive drum 11 is a cylindrical photosensitive body, which is a working part to have an electrostatic latent image formed by the charging roller 12 and the print head 13, have toner from the developing device 14 deposited on the latent image, and get the toner transferred to a printing medium 16. The charging roller 12 is a cylindrical roller set face to face with the photosensitive drum 11 to uniformly electrify the surface of the photosensitive drum 11. The print head 13 is arranged downstream of the charging roller 12 in the rotating direction of the photosensitive drum 11 to form an electrostatic latent image by irradiating the photosensitive drum 11 with light for exposure.

The developing device 14 to develop the electrostatic image to produce a toner image is arranged downstream of the print head 13 in the rotating direction of the photosensitive drum 11, and comprises a developing roller 21, sponge roller 22, toner 23, an agitator rod 24, a developer scraping blade 25, and a case 26. The case 26 contains and holds the toner 23.

The developing roller 21 is a cylindrical roller, which rotates in the arrow direction 21*a*, is arranged face to face with the photosensitive drum 11 to deposit toner on the electrostatic latent image formed on the photosensitive drum 11. The sponge roller 22 is in contact with the developing roller 21 and rotates in the same direction (in the arrow direction 22*a*) as the developing roller 21. After the toner is deposited on the photosensitive drum 11, the sponge roller 22 removes surplus toner from the developing roller 21, and, on the other hand, supplies toner afresh to the developing roller 21. The sponge roller 22 has at its center a conductive rod 22*b* to which a voltage Vs is applied.

The toner 23 is developing powder which is deposited on the electrostatic latent image on the photosensitive drum 11 to develop the image. The agitator rod 24 agitates the toner 23 in the case 26 to homogenize it. The developer scraping blade 25 thins down the toner 23 deposited on the surface of the developing roller 21 to a thin film of a constant thickness.

The transfer roller 15 rotates in the direction of the arrow and is arranged downstream of the developing device 14 in the rotating direction of the photosensitive drum 11 and is pressed to the photosensitive drum 11. The transfer roller 15 has a toner image transferred to the printing medium 16 fed between the photosensitive drum 11 and the transfer roller 15.

In the electrophotographic recording apparatus configured as described, when a motor, not shown, rotates to feed the printing medium 16 in the direction of the arrow 16*a*, the developing roller 21 and the sponge roller 22 in the developing device 14 rotate in the directions of arrows 21*a* and 22*a* respectively, and the toner 23 in the developing device 14 is agitated by the agitator rod 24 which rotates in the direction of the arrow 24*a*. At this time, negative voltages are applied to the developing roller 21 and the sponge roller 22 simultaneously, but in such a way that the absolute value of the applied negative voltage of the developing roller 21 is smaller. In the case of reversal development, negatively-charged toner 23 that was agitated is deposited on the surface of the sponge roller 22, and the deposited toner 23 is supplied to the surface of the developing roller 21 through contact of the sponge roller 22 with the surface of the developing roller 21 having a negative voltage the absolute value of which is smaller than that of the sponge roller 22. The toner deposited on the surface of the developing roller 21 is made thinner by the developer scraping blade 25 to a thin toner layer.

On the other hand, simultaneously with the rotation of the above-mentioned motor, not shown, a negative voltage is applied to the charging roller 12, and the photosensitive drum 11 is charged uniformly while rotating in the direction of the arrow 11*a*. After this, when the photosensitive drum 11 is irradiated with light from the print head 13, the regions exposed to light decrease in the level of charge to 0[V], so that an electrostatic latent image is formed on the surface of the photosensitive drum 11. The toner 23 deposited on the developing roller 21 is negatively-charged, and when the developing roller 21 contacts the electrostatic latent image on the photosensitive drum 11 or reaches a maximum proximate point, the toner 23 is deposited on the exposed regions. Meanwhile, because the regions not exposed to light are more negatively charged than the negatively-charged toner 23 on the developing roller 21, the toner 23 is not deposited on the unexposed regions. Subsequently, the toner image is transferred from the photosensitive drum 11 to a printing medium 16, and the toner image is fixed to the printing medium 16 by a fixing unit, not shown.

However, the conventional developing device has problems as follows.

FIG. 12 is a diagram for explaining the conventional problem.

The residues of toner (residual toner) 101 on the developing roller 21, which was not used by the photosensitive drum 11 and returned to the developing device 14, are scraped off on the downstream side of the contact area by the sponge roller 22. However, in a continuous printing process, for example, the residual toner 101 gets into a sponge portion 22*c* (indicated as toner 102) covering the periphery of the sponge roller 22, and solidifies to give rise to clogging of the sponge, thus deteriorating the toner removing performance of the sponge roller 22. Under this condition, the residual toner 101 is not detached completely on the downstream side of the contact area, and stays deposited on the developing roller 21 as indicated by the residual toner 101*a*. Consequently, there arises a difference in toner thickness on the surface of the developing roller 21 or a difference in potential of the toner between its first rotation and the second rotation when the residual toner 101*a* remains deposited on the developing roller 21, which is responsible for irregular print density.

In solid print, the image, which was used for printing in the first rotation, remains as a thin residual image in the second rotation. In other words, toner is deposited on the previous toner image which was not consumed on the photosensitive drum 11 and remains on the developing roller 21, with the result that a reverse image of the image in the first rotation is printed.

Further, irregular print density occurs for the reason as follows. The residual toner, which was once detached by scraping off from the developing roller 21, still stays deposited on the sponge roller 22. As the sponge roller 22 rotates, the residual toner is supplied together with other toner to the surface of the developing roller 21, making the toner layer not uniform and giving rise to irregular print density.

Irregular print density occurs for another reason. Immediately before starting printing, the image forming process starts, and to this end, the photosensitive drum 11 is subjected to preliminary charging by the charging roller 12. Simultaneously with the charging of the photosensitive drum 11, the surface of the developing roller 21 is also charged. Therefore, in a printing process with high density which consumes a relatively large amount of toner, such as solid print, a difference occurs in toner layer thickness between the first rotation of the developing roller 21 and in the second rotation when the surface is reset by detaching the toner once.

As mentioned above, the problem with the prior art is that irregular print density occurs which is attributable to the unevenness of the thickness of the toner layer.

SUMMARY OF THE INVENTION

A developing device for supplying, by a developer carrying body, a developer to an electrostatic latent image formed on a photosensitive body is proposed. The device includes a developer supplying member to supply a developer to the developer carrying body and to separate the developer remaining on the developer carrying body. Developer removing means is provided for contacting the developer supplying member and for removing the developer adhering to the developer supplying member.

EMBODIMENTS OF THE INVENTION

The modes of carrying out the present invention will be described in detail with reference to the following embodiments.

<Embodiment 1>

<Structure>

Figure 1:
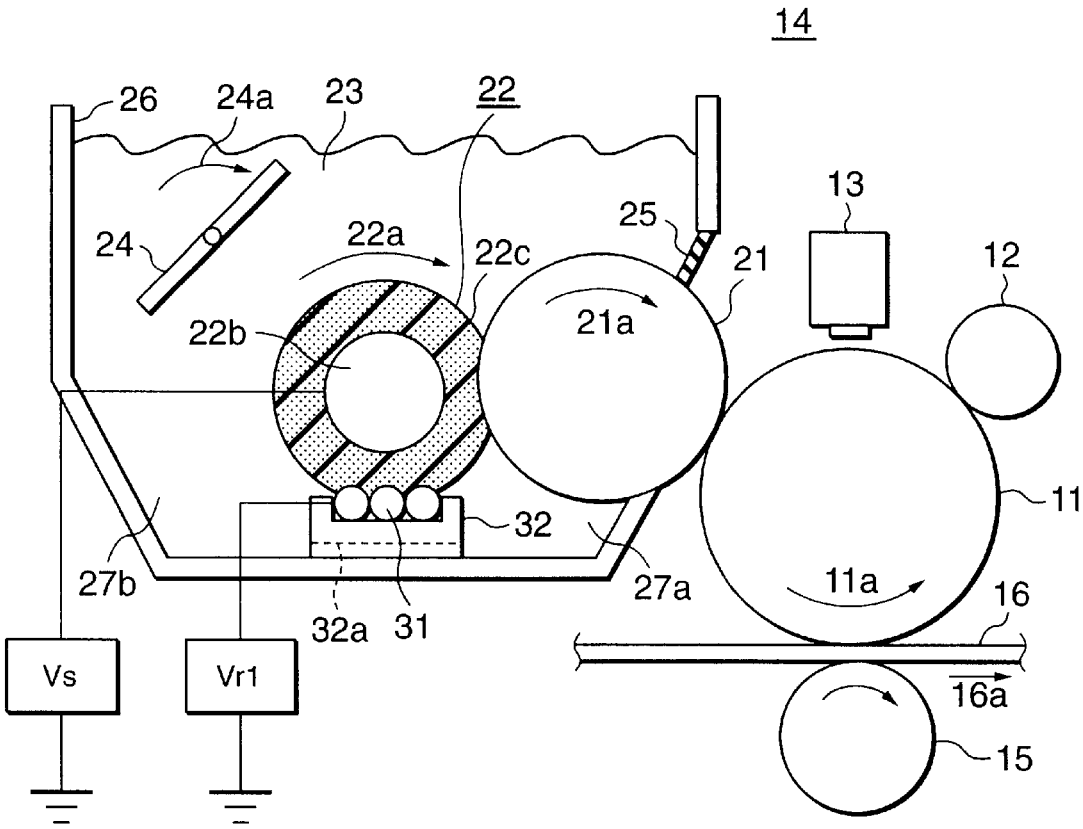
FIG. 1 is a block diagram of a first embodiment of the developing device according to the present invention.

A printer mechanism shown in FIG. 1 comprises a photosensitive drum 11, a charging roller 12, a print head 13, a developing device 14, and a transfer roller 15.

This mechanical block has the photosensitive drum 11 of a cylindrical shape, on which an electrostatic latent image is formed, and toner 23 from the developing device 14 is deposited on the latent image, and then a toner image is transferred to a printing medium 16. The charging roller 12 is a cylindrical roller arranged face to face with the photosensitive drum 11, and uniformly electrifies the surface of the photosensitive drum 11. The print head 13 is arranged downstream of the charging roller 12 in the rotating direction 11*a* of the photosensitive drum 11, irradiates the photosensitive drum 11 with light for exposure to form an electrostatic latent image.

The developing device 14 is arranged downstream of the print head 13 in the rotating direction of the photosensitive drum 11, and develops the electrostatic latent image to form a toner image on the photosensitive drum 11. The developing device 14 comprises a developing roller 21, a sponge roller 22, toner 23, an agitator rod 24, a developer scraping blade 25, a case 26, and a plurality of cylindrical members 31. The case 26 accommodates and holds the toner 23.

The developing roller 21 is a cylindrical roller, which is arranged face to face with the photosensitive drum 11 and deposits toner 23 on the electrostatic latent image on the photosensitive drum 11, and rotates in the direction of the arrow 21*a*. The sponge roller 22 is a sponge-covered roller, which contacts the developing roller 21, and rotates in the same direction as the developing roller 21 (the direction of the arrow 22*a*) to remove excess toner 23 on the developing roller 21 after the toner 23 was deposited on the photosensitive drum 11, and supply toner 23 to the developing roller 21 anew. A voltage Vs (−600V) is applied to a conductive rod 22*b* provided in the center of the sponge roller 22.

The toner 23 is a developer which is deposited on the electrostatic latent image on the photosensitive drum 11 to develop a toner image. The agitator rod 24 agitates the toner 23 in the case 26 to homogenize it. The developer scraping blade 25 is a plate member that scrapes off the toner 23 deposited on the developing roller 21 to a certain thickness.

The transfer roller 15 is arranged downstream of the developing device 14 in the rotating direction of the photosensitive drum 11 in a manner to be pressed against the photosensitive drum 11, and transfers the toner image to a printing medium 16 fed between itself and the photosensitive drum 11.

The plurality of cylindrical members 31 are conductive cylindrical members arranged at a lower position in the case 26 in a manner to contact the sponge portion 22*c* of the sponge roller 22. The cylindrical members 31 are immovably fixed on a stationary base 32 and are non-rotatable with their side end faces fixed by a fixture, not shown. A passage 32*a* is provided in the stationary base 32. This passage 32*a* interconnects a space 27*a* formed in the case 26 by the developing roller 21, the sponge roller 22, the cylindrical members 31, and the stationary base 32, and a space 27*b* filled with toner 23 in the case 26. Therefore, through the passage 32*a*, the toner 23 detached from the developing roller 21 by the sponge roller 22 and the cylindrical members 31 can move from the space 27*a* to the space 27*b*.

The above-mentioned voltage Vs (−600V) is applied to the conductive rod 22*b* of metal or resin, for example, provided at the center of the sponge roller 22 covered with a semiconductor sponge, while a voltage Vr1 (−200V~−300V) is applied to the cylindrical members 31.

<Operation>

In FIG. 1, when a motor, not shown, rotates to feed a printing medium 16 in the direction of the arrow 16*a*, the developing roller 21 and the sponge roller 22 in the developing device 14 rotate in the directions of the arrows 21*a*, 22*a*, and the agitator rod 24 rotates in the direction of the arrow 24*a* to agitate the toner 23. At the same time, a voltage of negative polarity, say, −300V is applied to the developing roller 21.

Therefore, the agitated, negatively-charged toner 23 is first deposited on the surface of the sponge roller 22, and when the surface of the sponge roller 22 contacts the surface of the developing roller 21 that has a smaller absolute value of applied voltage, owing to this voltage difference, the toner 23 is now deposited on the surface of the developing roller 21 and supplied. The toner 23 deposited on the surface of the developing roller 21 is made thinner by the developer scraping blade 25 to form a thin toner layer.

On the other hand, simultaneously with the rotation of a motor, not shown, a voltage of negative polarity, say, −1200V is applied to the charging roller 12, the photosensitive drum 11, while rotating in the direction of the arrow 11*a*, is uniformly charged. Consequently, the potential of the charge on the surface of the photosensitive drum 11 will be −700V, for example. After this, when the photosensitive drum 11 is irradiated with light from the print head 13, the regions exposed to light decrease in the level of charge to −50[V], so that an electrostatic latent image is formed on the surface of the photosensitive drum 11. Because the toner 23 deposited on the surface of the developing roller 21 is negatively charged, when the developing roller 21 contacts the electrostatic latent image on the photosensitive drum 11 or reaches a maximum approximate point, the toner 23 is deposited on the image. Meanwhile, the regions of the surface of the photosensitive drum 11 which were not exposed to light are more negatively charged (−700V) than the toner 23 on the developing roller 21, so that the toner 23 is not deposited on the unexposed regions on the photosensitive drum 11.

Next, description will be made of the detachment and removal of the residual toner in the developing device 14.

Figure 2:
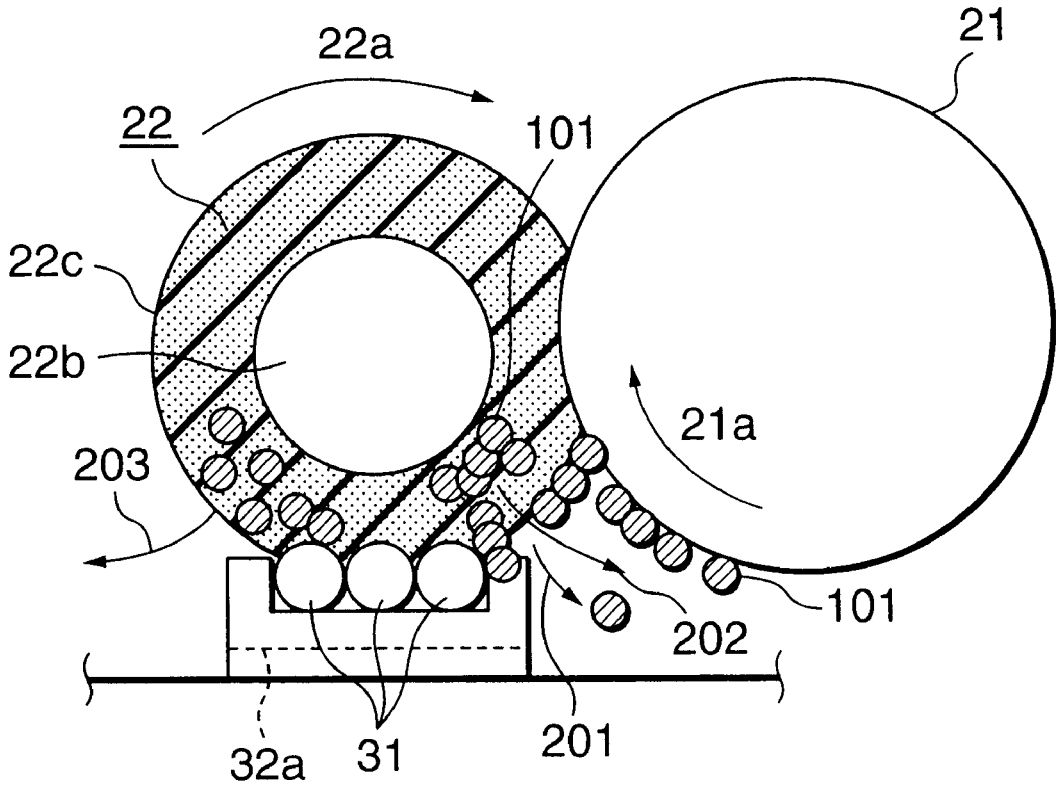
FIG. 2 is a diagram for explaining the operation of the first embodiment.

FIG. 2 is a diagram for explaining the operation of the first embodiment.

As shown in FIG. 2, in the developing device 14, residual toner 101 which was not deposited on the photosensitive drum 11 but remains on the surface of the developing roller 21 is scraped off by the sponge roller 22. The toner is mechanically detached in the direction of the arrow 201, for example.

As the sponge roller 22 rotates, the sponge portion 22*c* moves while it is deformed elastically by a plurality of cylindrical members 31. Therefore, as the sponge portion 22*c* is deformed repeatedly (as if it were vibrating), so that the toner 101 solidifies in clots in the sponge portion 22*c*, and is pushed out in the directions of the arrows 202, 203. Therefore, the sponge roller 22 can maintain its toner removing performance.

To electrically detach the toner from the sponge roller 22 by means of the cylindrical members 31, a negative voltage of Vr1 (−200V~−300V) is applied to the cylindrical members 31. Vr1 is set to meet a relation of the Vr1 to the voltage Vs (−600V) applied to the sponge roller 22 such that $|Vr1|<|Vs|$. Therefore, the negatively-charged toner is deposited on the cylindrical members 31. The removed residual toner 101 passes through the passage 32*a*, circulates and is supplied to the sponge roller 22 again.

Subsequently, the toner image is transferred from the photosensitive drum 11 to a printing medium 16, fixed to the printing medium 16 by a fixing unit, not shown, by which printing is finished.

<Effect>

As has been described, according to the first embodiment, the provision of a plurality of cylindrical members 31 contacting the sponge roller 22 makes it possible to mechanically and electrically separate the toner by the cylindrical members 31 when the sponge roller 22 removes the residual toner 101 by scraping off from the developing roller 21. Therefore, according to this embodiment, it is possible to improve and maintain the toner removing performance of the sponge roller 22. Consequently, irregular print density occurring at the periods of the developing roller 21 and the residual image phenomenon can be prevented, making it possible to provide an image forming device that produces high-quality and stable images.

In the first embodiment, the cylindrical members 31 are fixed not to prevent them from rotating, but the cylindrical members 31 may be rotatably supported. In this latter case, as the sponge roller 22 rotates, the cylindrical members 31 rotate as driven elements. According to this structure, the abrasion of the sponge portion 22C can be reduced, and the life of the sponge roller 22 can be prolonged.

Further, in the first embodiment, the developer removing means is structured as a plurality of cylindrical members 31 arranged in parallel, but the developer removing means is not limited to this design. Parts having an undulated sectional profile can achieve the same effects so long as they contact the surface of the sponge roller 22 and have a plurality of ups and downs in the moving direction of the sponge roller 22.

<Embodiment 2>

In a second embodiment of the present invention, a net-like member 41 is used for the developer removing means.

<Structure>

Figure 3:
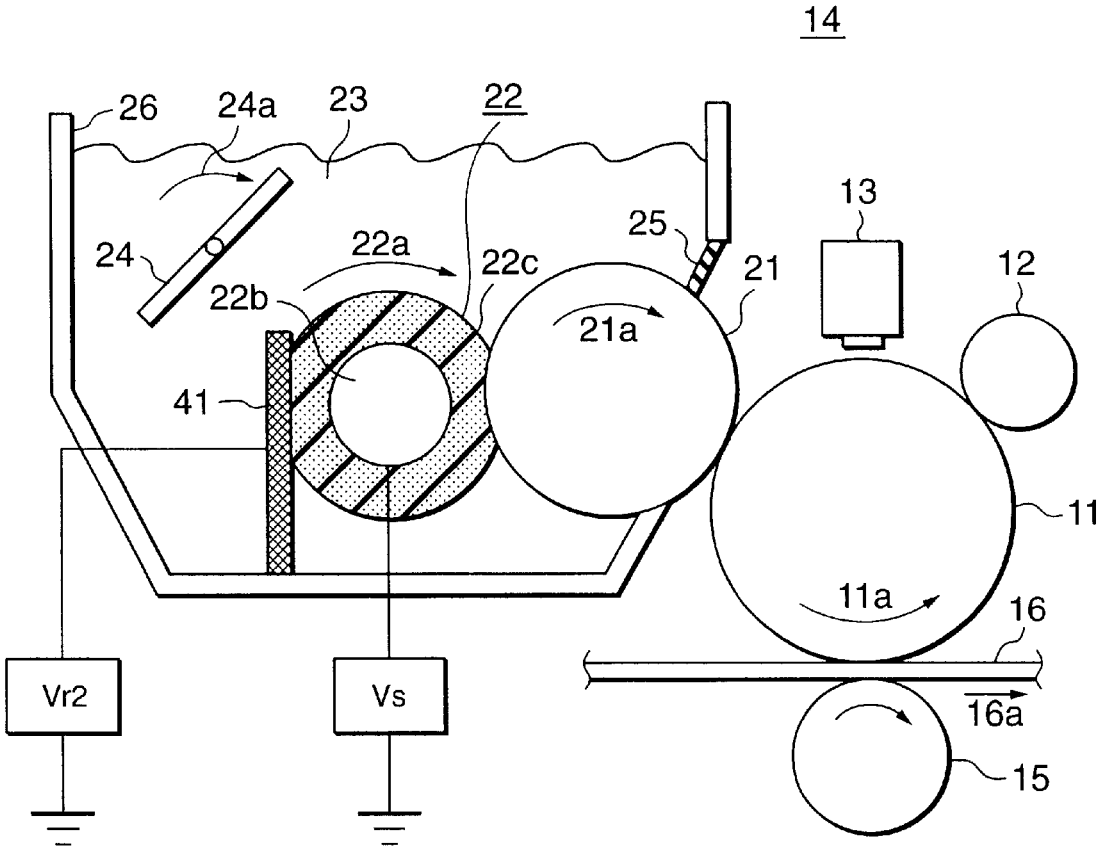
FIG. 3 is a block diagram of a second embodiment of the developing device according to the present invention.

FIG. 3 is a block diagram of the second embodiment.

A printer mechanism in FIG. 3 comprises a photosensitive drum 11, a charging roller 12, a print head 13, a developing device 14, a transfer roller 15, and a printing medium 16, and a developing device 14 comprises a developing roller 21, a sponge roller 22, toner 23, an agitator rod 24, a developer scraping blade 25, a case 26, and a net-like member 41. The components, from the photosensitive drum 11 up to case 26, are identical with those in the first embodiment shown in FIG. 1, and they are designated by the same reference numerals and will not be explained here.

The net-like member 41 is a solid-structured conductive net installed upright with one side of it in contact with the sponge portion 22*c* of the sponge roller 22, and fixed to the bottom of case 26. A negative voltage Vr2 (−200V to −300V) is applied to the net-like member 41.

<Operation>

In FIG. 3, the basic toner depositing operation is the same as in the first embodiment, and will not be described here. The removal process of the residual toner in the developing device 14 will be described in the following.

Figure 4:
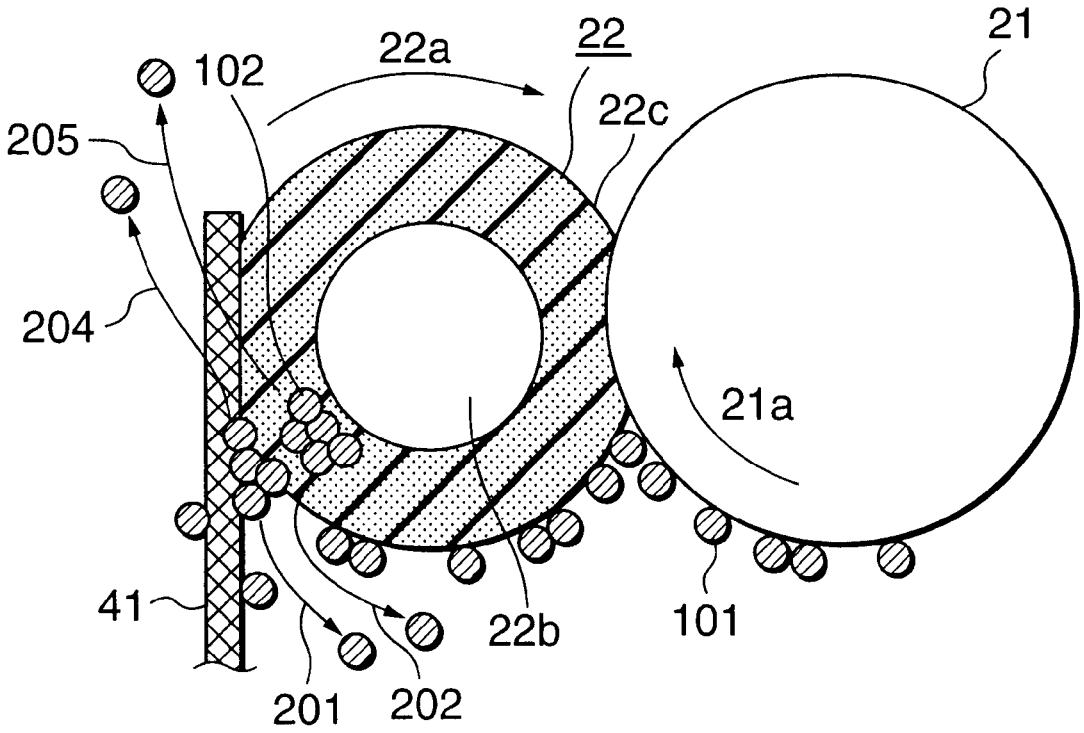
FIG. 4 is a diagram for explaining the operation of the second embodiment.

FIG. 4 is a diagram for explaining the operation of the second embodiment.

As shown in FIG. 4, in the developing device 14, when the sponge roller 22 scrapes off the residual toner 101 on the surface of the developing roller 21, the net-like member 41 prevents the scraped-off toner 101 from solidifying inside the sponge portion 22*c*, and removes the toner 101 by sending it, for example, in a direction 201 or in a direction 204 in which the toner 101 passes through the net-like member 41. Because the sponge portion 22*c* is deformed, the toner 102 that is solidified in the sponge portion 22*c* is pushed in a direction 202 or in a direction 205 after passing through the net-like member 41, for example. Therefore, the sponge roller 22 can maintain its toner removing performance.

To electrically detach the toner from the sponge roller 22, and for this purpose, to let the toner from the sponge roller 22 be deposited on the net-like member 41, a negative voltage Vr2 of −200V~−300V is applied to the net-like member 41. The negative voltage Vr2 is set to meet a relation of the Vr2 to the voltage Vs of −600V applied to the sponge roller 22 such that $|Vr2|<|Vs|$. Consequently, the negatively-charged toner moves toward the net-like member 41. Because the scraped-off toner can pass through the net-like member 41, the toner 23 is kept circulating even when the printing process is continued.

<Effect>

As has been described, according to the second embodiment, in which the net-like member 41 is so provided as to contact the sponge roller 22, when the residual toner 101 on the developing roller 21 is removed by being scraped off by the sponge roller 22, the net-like member 41 can mechanically and electrically detach the toner 101. Therefore, the toner removal performance of the sponge roller 22 can be improved and prolonged. Because this toner removing means, being of a net type, permits the detached toner to pass through it, and can avoid uneven distribution of toner in the case 26, and the toner can circulate smoothly even if printing is carried out continuously. As a result, irregular print density occurring with rotating periods of the developing roller 21 and the residual image phenomenon can be prevented and an image forming device can be realized which produces high-quality and stable images.

In the second embodiment, the net-like member 41 is mounted upright, but it can be mounted in any manner so long as one side of it is in contact with the surface of the sponge roller 22. For example, the net-like member 41 may be installed at the bottom or at the top of the sponge roller 22 though this requires that a fixture be provided separately.

<Embodiment 3>

In a third embodiment of the present invention, as the developer removing means, there is provided a roller member 51 which contacts the sponge roller 22 and rotates in the same direction as the sponge roller 22 (the contact faces of the two rollers move in opposite directions).

<Structure>

Figure 5:
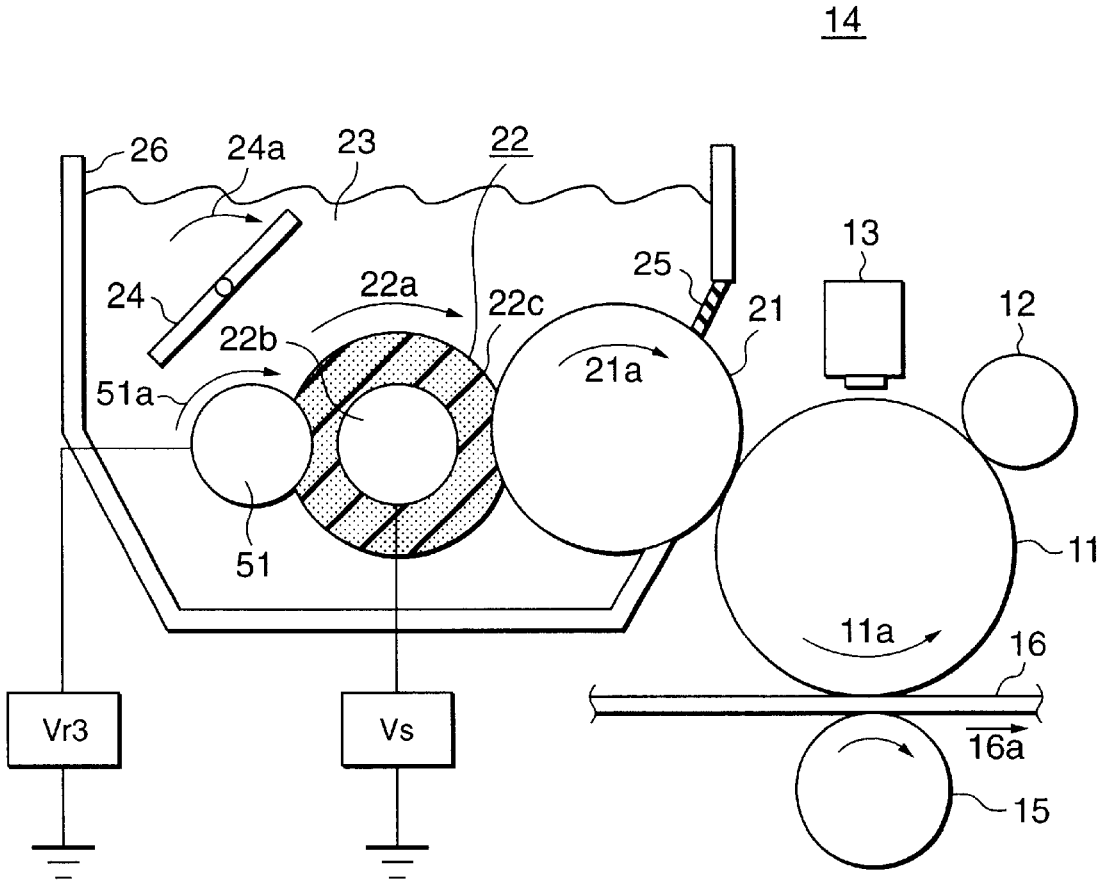
FIG. 5 is a block diagram of a third embodiment of the developing device according to the present invention.

FIG. 5 is a block diagram of the third embodiment.

A printer mechanism shown in FIG. 5 comprises a photosensitive drum 11, a charging roller 12, a print head 13, a developing device 14, a transfer roller 15, and a printing medium 16; and the developing device 14 comprises a developing roller 21, a sponge roller 22, toner 23, an agitator rod 24, a developer scraping blade 25, a case 26, and a roller member 51. The components, from the photosensitive drum 11 to case 26 are identical with those of the first and second embodiments, the common components are designated by the same reference numerals, and their descriptions are omitted.

The roller member 51 is a conductive and inelastic member of metal, for example, of circular cross section, so arranged as to interfere on the outer circumferential surface with the sponge portion 22*c* of the sponge roller 22 (contact the sponge portion 22*c* to such an extent to slightly deform it). The roller member 51 is so formed as to be rotatably driven in the same direction as the rotating direction of the sponge roller 22 by driving means, not shown. A voltage Vr3 (−200V~−300V) of negative polarity is applied to the roller member 51.

<Operation>

In FIG. 5, the basic toner depositing operation is the same as in the first and second embodiments, and its description is omitted here. Description will be made of the removing process of toner 23 in the developing device 14.

Figure 6:
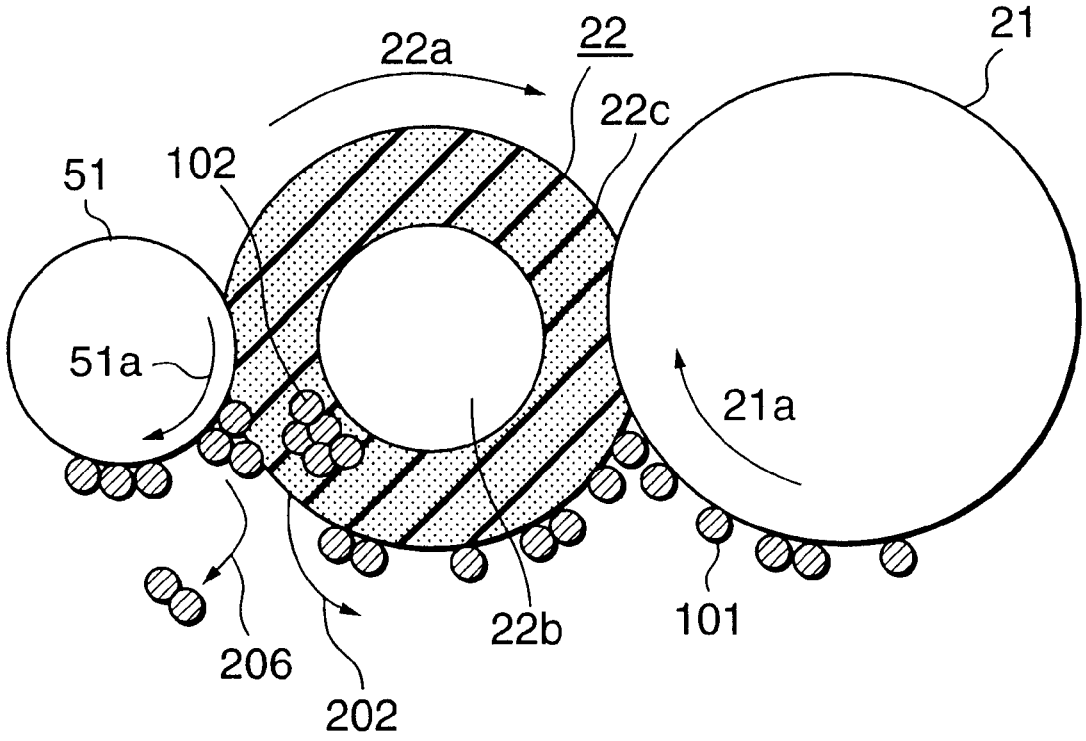
FIG. 6 is a diagram for explaining the operation of the third embodiment.

FIG. 6 is a diagram for explaining the operation of the third embodiment of the present invention.

As shown in FIG. 6, in the developing device 14, when the sponge roller 22 scrapes off the residual toner 101 from the surface of the developing roller 21, the roller member 51 is rotated in the direction of the arrow 51*a* by a motor, not shown, and ejects the scraped-off toner in the direction of the arrow 206, for example, without letting it solidify and stay inside the sponge portion 22*c*. As the sponge portion 22*c* is deformed, the toner that solidified in the sponge portion 22*c* is pushed away in the direction of the arrow 202, for example. In this manner, the sponge roller 22 can maintain the toner removing performance.

To electrically separate the toner from the sponge roller 22, and accordingly, to let the toner from the sponge roller 22 be attracted to the roller member 51, a negative voltage Vr3 of −200V~−300V is applied to the roller member 51. The negative voltage Vr3 is set to meet a relation of the Vr3 to the voltage Vs of −600V applied to the sponge roller 22 such that $|Vr3|<|Vs|$. Hence, the negatively-charged toner moves toward the roller member 51.

<Effect>

As has been described, according to the third embodiment, in which the roller member 51 is provided so as to contact the sponge roller 22 and rotate in the opposite direction to the moving surface of the sponge roller 22, when the residual toner 101, which was not consumed and remains on the developing roller 21, is removed by being scraped off by the sponge roller 22, the roller member 51 can mechanically and electrically detach the toner. Therefore, the toner removing performance of the sponge roller 22 can be improved and prolonged. Therefore, irregular print density occurring at rotating periods of the developing roller 21 and the residual image phenomenon can be prevented, and an image forming device can be realized which produces high-quality and stable images.

<Embodiment 4>

In a fourth embodiment of the present invention, the roller member 51 in the third embodiment and a contact member 52 contacting the surface of the roller member 51 are provided as the developer removing means.

<Structure>

Figure 7:
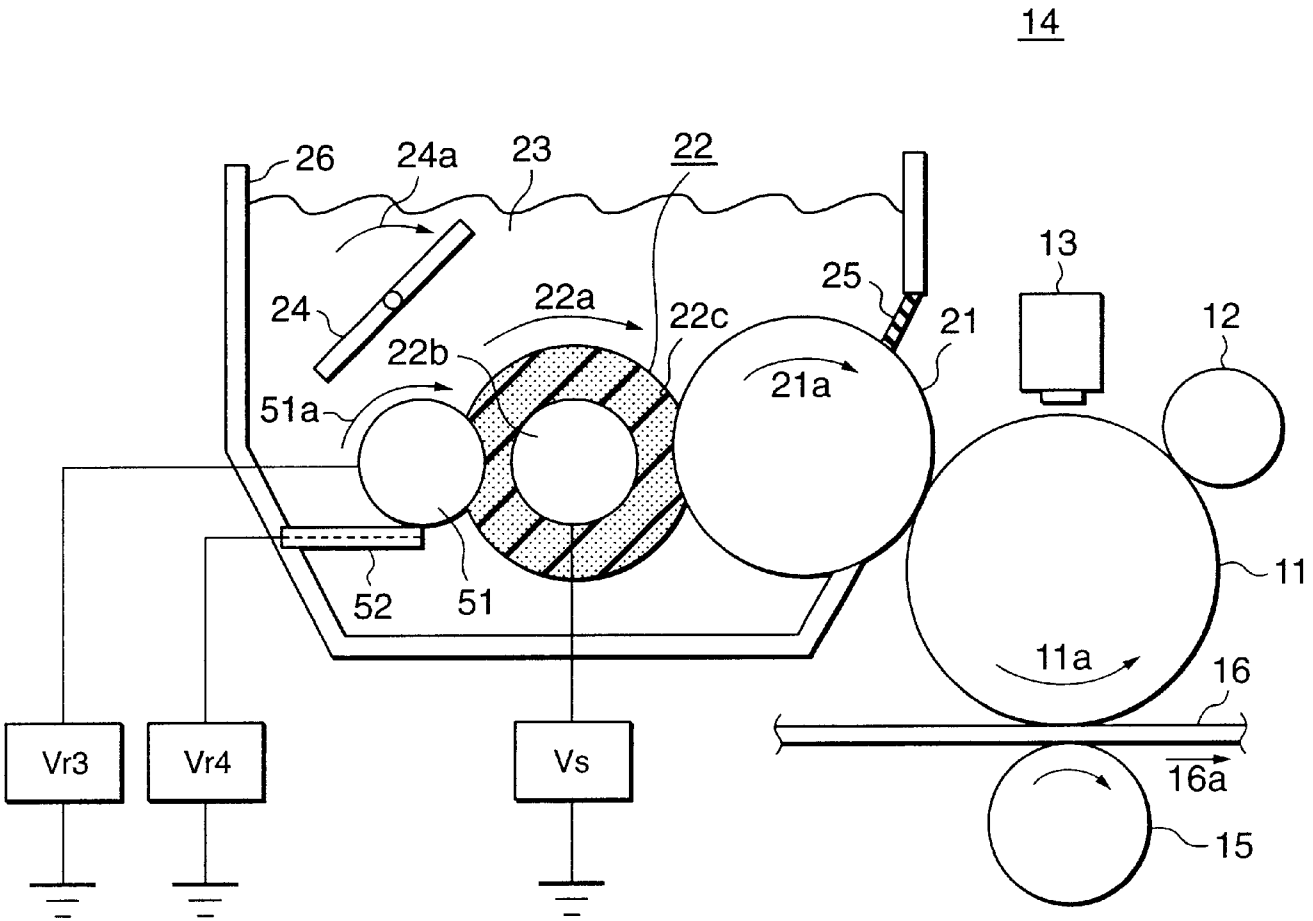
FIG. 7 is a block diagram of a fourth embodiment of the developing device according to the present invention.

FIG. 7 is a block diagram of a fourth embodiment of the present invention.

A printer mechanism in FIG. 7 comprises a photosensitive drum 11, a charging roller 12, a print head 13, a developing device 14, a transfer roller 15, and a printing medium 16, and the developing device 14 comprises a developing roller 21, a sponge roller 22, toner 23, an agitator rod 24, a developer scraping blade 25, a case 26, a roller member 51, and a contact member 52. The components, from the photosensitive drum 11 up to the case 26, are the same as in the first to third embodiments, and the common components are designated by the same reference numerals. The roller member 51 is the same as in the third embodiment, and its description is omitted here.

The contact member 52, made of an elastic plate having electric conductivity, is at one end of it contacting the bottom portion of the roller member 51 and is fixed so as to be substantially horizontal. The contact member 52 has a plurality of slits 52*a* (See FIG. 8) formed at certain intervals along the longitudinal direction thereof (in a direction parallel with the rotating axis of the roller member 51) in an area away from the end portion thereof that contacts the roller member 51, those slits 52*a* being openings through which the toner passes and circulates.

A negative voltage Vr4 of −50V~−100V is applied to the contact member 52.

<Operation>

In FIG. 7, the basic toner depositing operation is the same as in the first to third embodiments, and its description is omitted here. The residual toner removing process in the developing device 14 is described.

Figure 8:
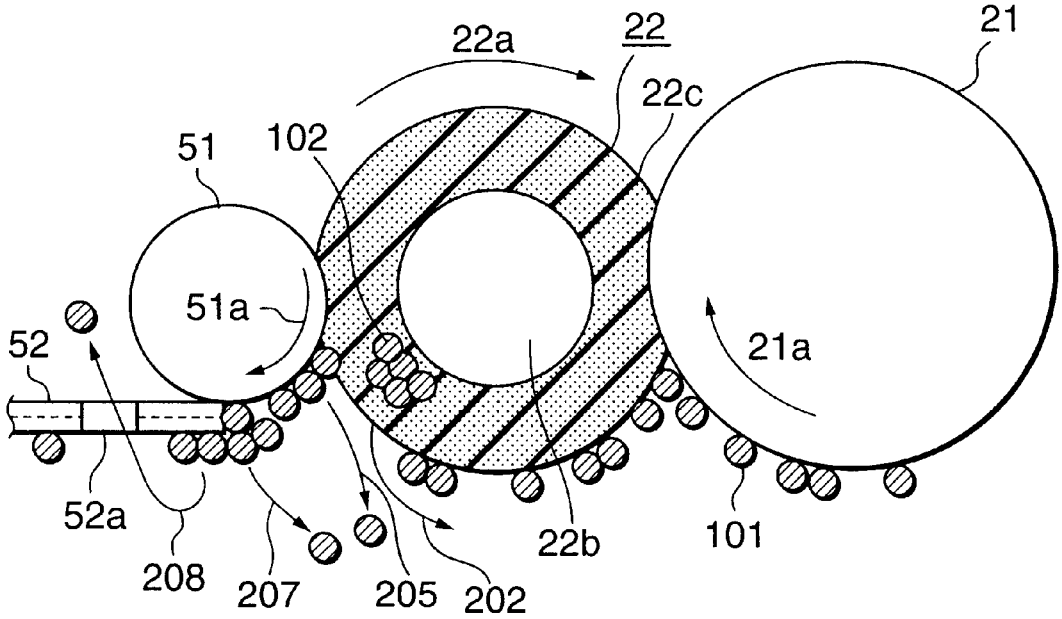
FIG. 8 is a diagram for explaining the operation of the fourth embodiment.

FIG. 8 is a diagram for explaining the operation of the fourth embodiment of the present invention.

As shown in FIG. 8, in the developing device 14, when the sponge roller 22 scrapes off the residual toner 101 from the surface of the developing roller 21, the roller member 51 is rotated in the direction 51*a* by a motor, not shown, mechanically ejects the scraped-off toner in the direction of the arrow, for example, without letting it solidify and stay inside the sponge portion 22*c*. As the sponge portion 22*c* is deformed, the toner that solidified in the sponge portion 22*c* is pushed away in the direction of the arrow, for example. In this manner, the sponge roller 22 can preserve the toner removing performance.

To electrically separate the toner from the sponge roller 22, and accordingly, to let the toner from the sponge roller 22 be attracted to the roller member 51, a negative voltage Vr3 of −200V~−300V is applied to the roller member 51. The negative voltage Vr3 is set to meet a relation of the Vr3 to the voltage Vs of −600V applied to the sponge roller 22 such that $|Vr3I<|Vs|$. Therefore, the negatively-charged toner moves toward the roller member 51. The operations mentioned so far are the same as in the third embodiment.

In the fourth embodiment, the toner deposited on the roller member 51 is separated by the contact member 52, and moves, for example, in the direction of the arrow 207 and in the direction of the arrow 208 to pass through the slit 52*a* of the contact member 52. As a negative voltage Vr4 of −50V~−100V is applied to the contact member 52 to meet a relation of the Vr4 to the voltage Vr3 of −200V~−300V applied to the roller member 51 such that Vr4<Vr3, and therefore the negatively-charged toner is attracted to the contact member 52.

<Effect>

As described above, according to the fourth embodiment, the structure of the third embodiment is added with the contact member 52 which contacts the roller member 51, and therefore the effects of the third embodiment are further added with an effect that the toner removing performance of the roller member 51 can be made more durable.

The contact member 52 may be formed of a conductive elastic resin or may be structured as a brush which is conductive. In short, the contact member 52 may be any type so long as it is conductive and structured so as to scrape toner off.

The contact member 52 is not limited to the fixed position mentioned above, but may be in any fixed condition. For example, the contact member 52 may be installed on the side of the roller member 51 opposite the side where the roller member 51 contacts the sponge roller 22, or at the top of the roller member 51.

<Embodiment 5>

In a fifth embodiment of the present invention, the voltage applied to the developing roller 21 in preliminary charging is controlled so that a difference between this voltage and a voltage, at which the photosensitive drum 11 is charged, is small.

<Structure>

Figure 9:
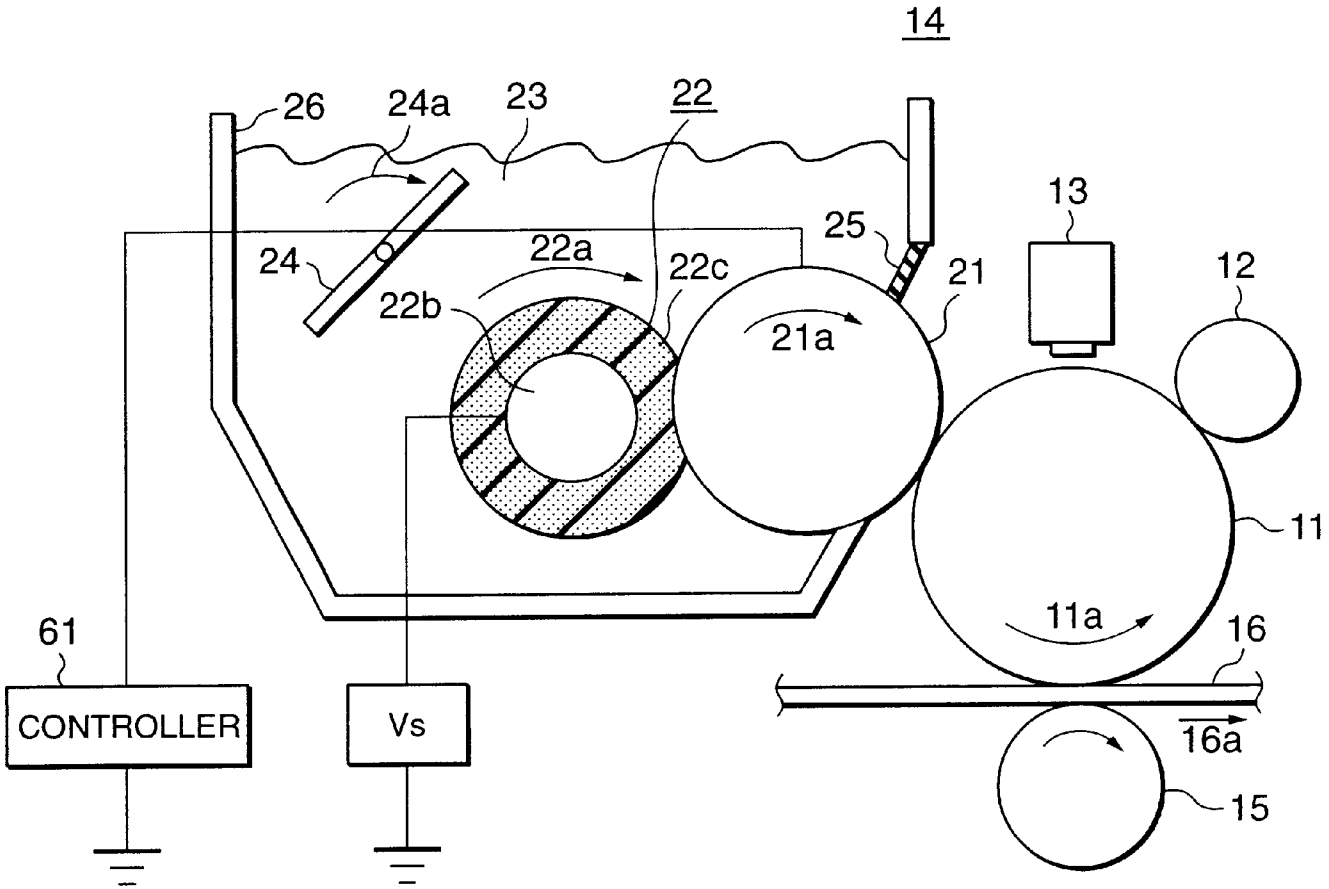
FIG. 9 is a block diagram of a fifth embodiment of the developing device according to the present invention.

FIG. 9 is a block diagram of the fifth embodiment.

A printer mechanism shown in FIG. 9 comprises a photosensitive drum 11, a charging roller 12, a print head 13, a developing device 14, a transfer roller 15, and a printing medium 16, and the developing device 14 comprises a developing roller 21, a sponge roller 22, toner 23, an agitator rod 24, a developer scraping blade 25, a case 26, and a controller 61. The components, from the photosensitive drum 11 to the case 26, are the same as in the first to fourth embodiments, and their descriptions are omitted here.

The controller 61 controls the voltage of the developing roller 21 so that, during preliminary charging of the photosensitive drum 11, a potential difference between the preliminary charging voltage to the photosensitive drum 11 and the applied voltage of the developing roller 21 is smaller than a potential difference during print charging. More specifically, the controller 61 controls the voltage of the developing roller 21 so that if a voltage Vd applied to the developing roller 21 during print charging is designated as Vd1 and the voltage Vd during preliminary charging is designated as Vd2, the relation between Vd1 and Vd2 is $|Vd1|<|Vd2|$, and that a voltage difference ($|Vo-Vd|$) between the charging voltage Vo to the photosensitive drum 11 (in other words, the voltage applied to the charging roller 12) and the applied voltage of the developing roller 21 during preliminary charging is decreased.

The developing roller 21 comprises a resin, such as rubber, and has a metal rod disposed at its center, and the voltage Vd is applied to this conductive metal rod.

<Operation>

In FIG. 9, the basic toner depositing operation is the same as in the other embodiments except that the voltage applied to the developing roller 21 changes. Therefore, description of the toner depositing operation is omitted here, and the operation different from the other embodiments will be described in the following.

Figure 10:
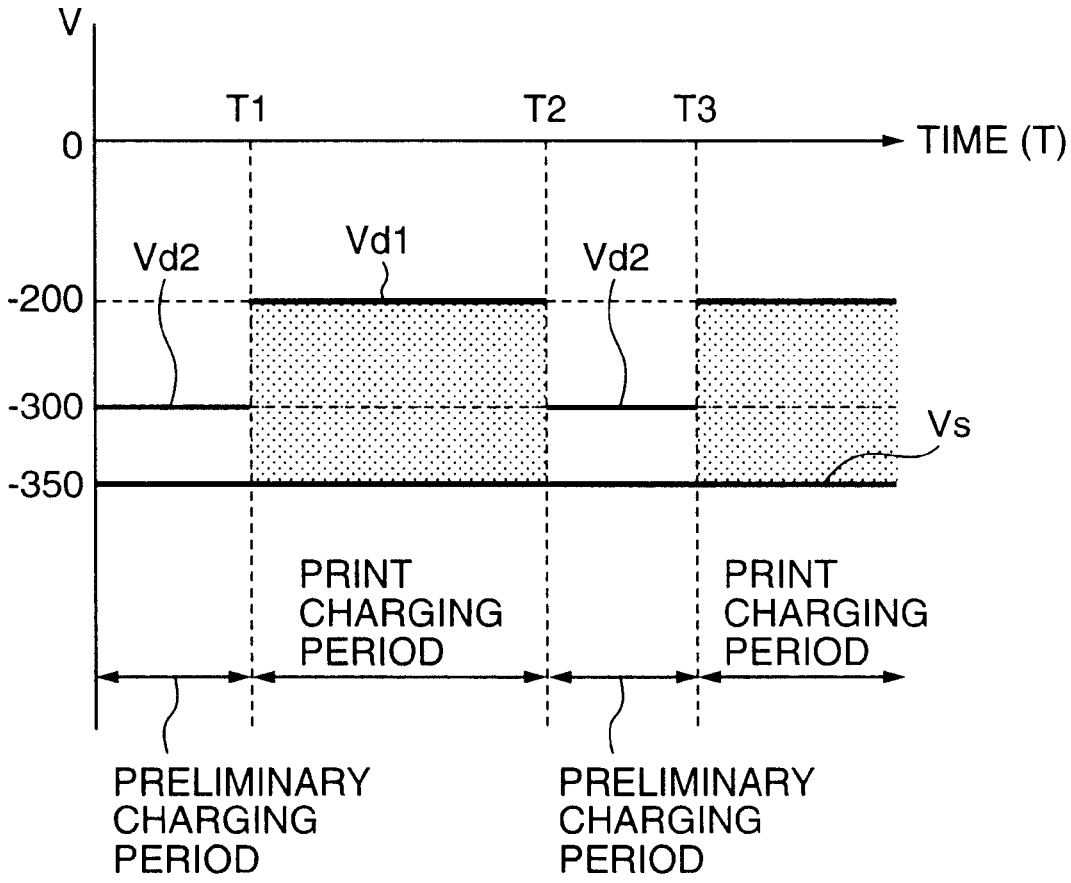
FIG. 10 is a time chart for explaining the operation of the fifth embodiment.
Figure 11:
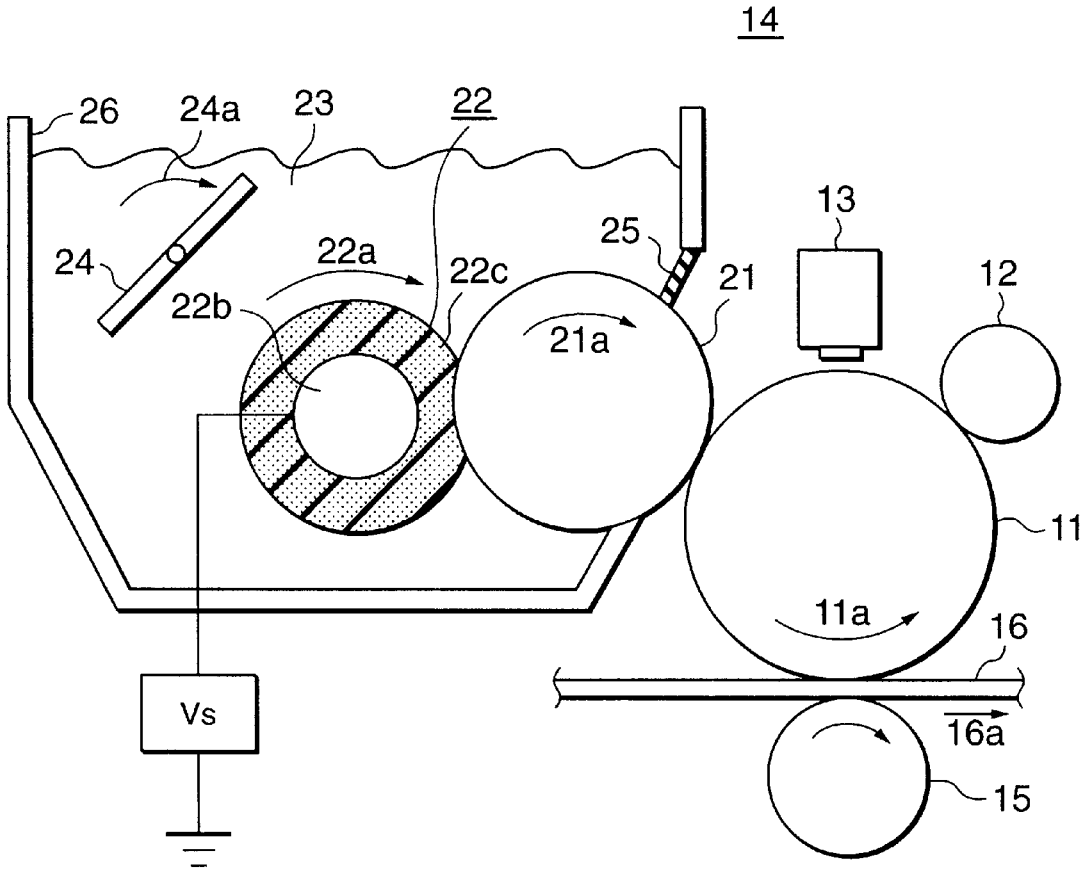
Fig.11 Prior Art
FIG. 11 is a block diagram of a conventional developing device.
Figure 12:
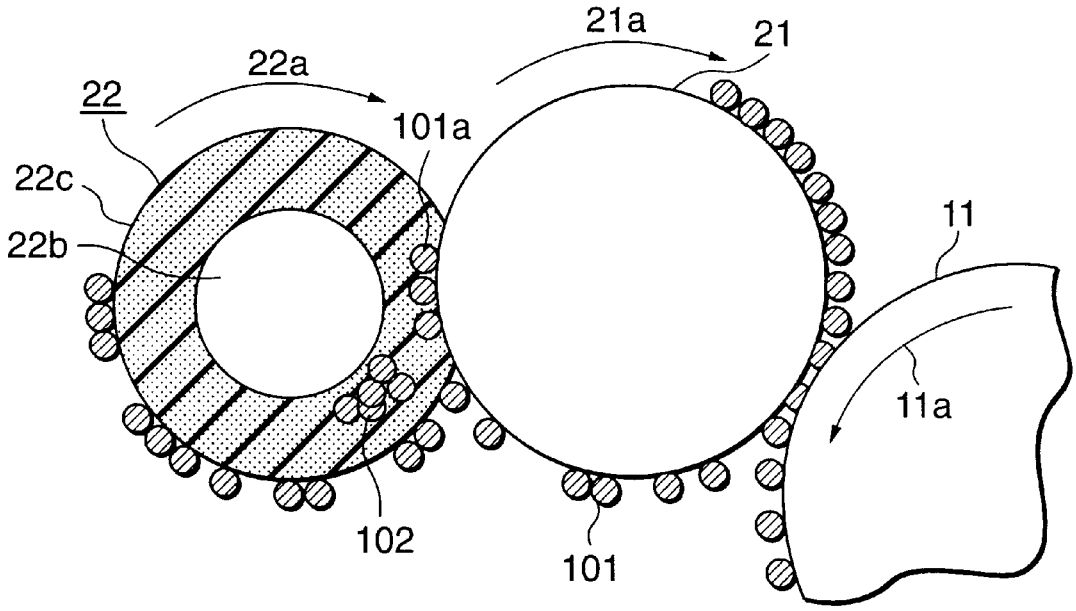
Fig.12 Prior Art
FIG. 12 is a diagram for explaining a conventional problem.

FIG. 10 is a time chart showing changes in the voltage applied to the developing roller 21.

A print charging period is an actual printing operation period when toner is supplied from the developing roller 21 to the photosensitive drum 11, and a preliminary charging period is a process in which the photosensitive drum 11 is subjected to preliminary charging before the printing operation is started or before a printing step after a paper space time.

The controller 61 sets the applied voltage Vd2 of the developing roller 21 at −300V during preliminary charging (~time T1), and sets the applied voltage Vd1 at a normal voltage of −200V during print charging (time T1~time T2). These settings apply to the subsequent preliminary charging (time T2~time T3) and print charging (time T3~). The charging voltage Vo to the photosensitive drum 11 (namely, the applied voltage of the charging roller 12) Vo is −700V, and the applied voltage Vs of sponge roller 22 is −350V.

In the fifth embodiment, the applied voltage of the developing roller 21 is set to −300V during a preliminary charging period, a voltage difference |Vo−Vd2| is reduced to 400V, which is less than the voltage difference of 500V in cases where the applied voltage of the developing roller 21 is fixed at −200V. Therefore, the developing roller 21 is made less likely to be affected by charge increase caused by the photosensitive drum 11.

In other words, if there is a potential difference of about 500V or more between the photosensitive drum 11 and something that comes into contact with the photosensitive drum 11, it is well known that charge-up occurs between them. For this reason, in the fifth embodiment, the potential difference between the photosensitive drum 11 and the developing roller 21 during preliminary charging is limited to not more than 500V to prevent charge-up on the developing roller 21.

For this reason, at print charging, the potential on the developing roller 21 is quickly switched to a normal level of −200V, and this makes it possible to reduce a difference in toner layer thickness between in the first rotation and the second and following rotations in high-density printing, such as solid print, thereby reducing irregularity in print density.

In a preliminary charging period, a potential difference between the developing roller 21 and the sponge roller 22 is small, but this does not affect the printing operation because the printing operation is not performed during the preliminary charging period, and toner need not be supplied.

In the fifth embodiment, the applied voltage to the developing roller 21 in a preliminary charging period is set at −300V, but this should not be construed to show a limited value and may be varied if it is necessary according to the charging voltage to the photosensitive drum 11, the applied voltage to the developing roller 21 or a kind of material of the developing roller 21 so long as it is possible to decrease the voltage difference between the photosensitive drum 11 and the developing roller 21.

<Effect>

As has been described, according to the fifth embodiment, the applied voltage to the developing roller 21 is controlled so that a difference between this applied voltage and the surface potential of the photosensitive drum 11 during a preliminary charging period, and therefore the developing roller 21 is not likely to be affected by charge-up caused by the photosensitive drum 11 and irregular print density can be eliminated even in a high-density printing process, such as solid print.

<Mode of Use>

In the third and fourth embodiments, the roller member 51 as the developer removing means is rotatably driven in the same direction as the sponge roller 22, but it may be arranged that the roller member 51 is rotatably driven in the opposite direction of the rotation of the sponge roller 22 (such that the surface of the roller member 51 moves in the same direction as the moving direction of the surface of the sponge roller 22). Note that in this case, it is necessary to arrange that the moving speed of the surface of the roller member 51 differs from the moving speed of the surface of the sponge roller 22. In other words, if it is arranged that the surface of the sponge roller 22 moves relative to the surface of the roller member 51, the same effects can be obtained as in a case where the surface of the sponge roller 22 moves in the opposite direction of the moving direction of the surface of the roller member 51 as described in the third and fourth embodiments.

In the first to fourth embodiments, the relation of the applied voltage (Vr) of the cylindrical members 31, the net-like member 41, or the roller member 51 with respect to the applied voltage of the sponge roller 22 is set such that |Vr|<|Vs|, but moreover it is possible to perform control as follows.

Figure 13:
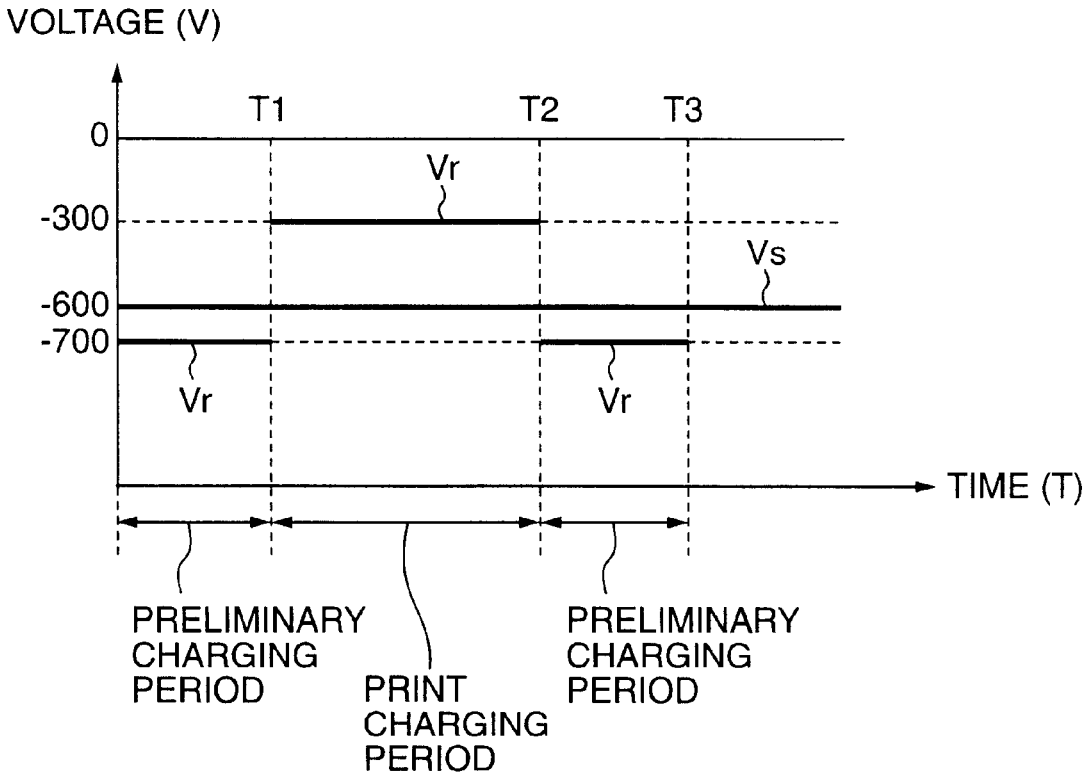
FIG. 13 is a timing chart for explaining control of applied voltages of the developer removing means and the sponge roller according to the present invention.

For example, as shown in FIG. 13, voltages are applied such that |Vr3(−300V)|<|Vs(−600V)| in normal printing. Further, it is possible to apply voltages such that |Vr(−700V)|>|Vs(−600V)| at timing not concerned with printing, such as preliminary charging. This leaves a possibility that if voltages are applied such that |Vr3|<|Vs| at all times, toner removed from the sponge roller 22 will be left deposited on the surface of the roller member 51. However, by applying voltages such that |Vr3|>|Vs| at timing not concerned with printing, at this time in point, the toner moves from the roller member 51 to the sponge roller 22, by which the surface of the roller member 51 is refreshed. Consequently, the roller member's action of removing the toner from the sponge roller 22 can be preserved for a long period of time, making it possible to maintain stable, high-quality of images. Above all else, even when the contact member 52 is provided as in the fourth embodiment, the toner not completely scraped off by the contact member 52 can be allowed to move to the side of the sponge roller 22. This further improves the toner removing action of the roller member 51.

The structure of the fifth embodiment may be combined with any of the first to fourth embodiment or modifications of the third and fourth embodiments. In other words, it may be arranged that means to control an applied voltages in preliminary charging to the developing roller 21 should be added to the developing device 14 in which a developer removing means is provided for the sponge roller 22.

The surfaces of the cylindrical members 31 and the roller member 51 should preferably be made smooth to make it possible to remove the toner deposited on the sponge roller 22 without damaging the sponge roller 22.

Further, in each embodiment, a photosensitive body has been described as the photosensitive drum 11, a charging means as the charging roller 12, an exposure means as the print head, a developer carrying body as the developing roller 21, and a developer supplying member as the sponge roller 22. Any form of component may be used so long as it achieves the same function. For example, the photosensitive body may be a belt running in an elliptical track. The present invention may be applied to various types of mechanisms. Each embodiment has been described referring to a reversal development type developing device, but the present invention may be applied to normal development type developing devices.

What is claimed is:

1. A developing device for supplying, by a developer carrying body, a developer to an electrostatic latent image formed on a photosensitive body by exposure by exposing means after said photosensitive body is charged by charging means, comprising:

a developer supplying member to supply said developer to said developer carrying body and to separate said developer remaining on said developer carrying body; and developer removing means for contacting said developer supplying member and for removing said developer adhering to said developer supplying member, wherein said developer supplying member moves while in contact with said developer carrying body and wherein said developer removing means is in a shape having a plurality of ups and downs formed in a moving direction of said developer supplying member.

2. A developing device according to claim 1, wherein said developer removing means comprises a plurality of rod-shaped members each of which has a circular section and is supported rotatably in a moving direction of said developer supplying member.

3. A developing device for supplying, by a developer carrying body, a developer to an electrostatic latent image formed on a photosensitive body by exposure by exposing means after said photosensitive body is charged by charging means, comprising:

a developer supplying member to supply said developer to said developer carrying body and to separate said developer remaining on said developer carrying body; and developer removing means for contacting said developer supplying member and for removing said developer adhering to said developer supplying member, wherein said developer supplying member moves while in contact with said developer carrying body and wherein said developer removing means comprises a net member, and wherein at least some of the developer removed by said net member passes through said net member to facilitate a circulation of the developer.

4. A developing device for supplying, by a developer carrying body, a developer to an electrostatic latent image formed on a photosensitive body by exposure by exposing means after said photosensitive body is charged by charging means, comprising:

a developer supplying member to supply said developer to said developer carrying body and to separate said developer remaining on said developer carrying body; and developer removing means for contacting said developer supplying member and for removing said developer adhering to said developer supplying member, wherein said developer supplying member moves while in contact with said developer carrying body and wherein said developer removing means comprises a metal roller member, having a circular section, rotating with a contact face thereof moving relatively to a moving direction of said developer supplying member.

5. A developing device according to claim 4, wherein said developer removing means comprises said roller member and a contact member fixedly contacting said roller member.

6. A developing device according to claim 5, wherein said contact member is formed to elastically contact said roller member.

7. A developing device according to claim 6, wherein said contact member has a gap to permit said developer to pass therethrough.

8. A developing device according to claim 5, wherein said roller member and said contact member are formed by a conductive material and are given absolute values of potential so that each of said absolute values of potential of said contact member, said roller member and said developer supplying member is in a relation of said contact member <=said roller member <said developer supplying member.

9. A developing device for supplying, by a developer carrying body, a developer to an electrostatic latent image formed on a photosensitive body by exposure by exposing means after said photosensitive body is charged by charging means, comprising:

a developer supplying member to supply said developer to said developer carrying body and to separate said developer remaining on said developer carrying body; and developer removing means for contacting said developer supplying member and for removing said developer adhering to said developer supplying member, wherein said developer removing means is given a potential so as to make said developer flow from said developer removing means to said developer supplying member at predetermined timing.

10. A developing device for supplying, by a developer carrying body, a developer to an electrostatic latent image formed on a photosensitive body by exposure by exposing means after said photosensitive body is charged by charging means, comprising:

a controller for changing a voltage applied to said developer carrying body so that a difference between a preliminary charging voltage applied to said photosensitive body and an applied voltage of said developer carrying body is smaller in preliminary charging than in print charging.

* * * * *